United States Patent [19]

Bilsbury

[11] Patent Number: 4,479,438

[45] Date of Patent: Oct. 30, 1984

[54] SABOTED SHOT

[75] Inventor: Stephen J. Bilsbury, Bethalto, Ill.

[73] Assignee: Olin Corporation, Stamford, Conn.

[21] Appl. No.: 463,233

[22] Filed: Feb. 2, 1983

[51] Int. Cl.³ ..... F42B 7/02

[52] U.S. Cl. ..... 102/454; 102/452; 102/520

[58] Field of Search ..... 102/448–463, 102/438, 501, 520–523, 532

[56] References Cited

U.S. PATENT DOCUMENTS 553,062 1/1896 Follett ..... 102/452
1,742,817 1/1930 Larson ..... 102/532
3,132,588 5/1964 Schafer ..... 102/42
3,598,057 8/1971 Potter ..... 102/460

FOREIGN PATENT DOCUMENTS 1427721 3/1976 United Kingdom ..... 102/449

*Primary Examiner*—Harold J. Tudor
*Attorney, Agent, or Firm*—Bruce E. Burdick

[57] ABSTRACT

A multi-part sabot for maintaining roundness of shot pellets during launch and passage of the pellets through a smooth bore harrel. The sabot is a coaxial stack of at least two cylindrical wafers, each dimpled to individually surround and protect the shot pellants.

5 Claims, 4 Drawing Figures

SABOTED SHOT

BACKGROUND AND SUMMARY OF THE INVENTION

This invention relates to shot columns.

Existing buckshot cartridges have a distinct disadvantage at long (beyond 50 meters) ranges. A loss of sphericity is a principle cause of pattern spreading. It also induces a high drag coefficient which slows down the buckshot.

Unprotected shot becomes deformed when subjected to high accelerations mainly because the bottom shot pellets are literally crushed by accelerative forces exerted by those pellets above and around them. The shot on the bottom layer deforms more than that on the top layer. Crushed shot is less spherical and thus travels more erratically and slows down quicker. Less uniform shot travels less uniformly.

It is well known that increasing the hardness of the shot, such as by alloying antimony with the lead shot, increases the hardness of the shot and reduces shot deformation. This harder shot gives more uniform patterns at longer ranges because more uniform shot travels more uniformly. The addition of a buffering material, such as granular polyethylene, as found in premium loads currently manufactured by all three of the leading shotshell manufacturers after having been originated by Winchester, has been shown to have significantly beneficial effects because the buffering material is deformed before the lead shot. Alloying and buffering seek to better preserve the initial spherical shape of the shot from the time it is fired until it exits the barrel muzzle.

Two additional beneficial approaches to reducing shot deformation were also originated by Winchester. First was the plating of copper upon the softer lead in order to give more hardness and a better aesthetic appearance. Second was the development of a plastic shot collar to surround the shot and protect it from abrasions during its travel down the barrel bore.

Nevertheless, it is widely recognized by industry experts that the current effective range of 000 buckshot is about 50 meters even with the premium loads such as Winchester Super Double X Magnum premium shotshell loads. As was the case back in 1921 when John Olin developed the Super-X extended range shotshell to be able to out-distance his duck hunting friends, present day shotshell designers continue to look for ways of extending the effective range of shot.

This invention further minimizes shot deformation and thus extends the effective range of shotshells by providing a saboted shot.

DETAILED DESCRIPTION OF THE PREFERRED EMBODIMENTS

As part of the present invention, it has been recognized that if a sabot could be molded which provided full support for each shot pellet in a buckshot load, then several benefits might be derived. First, tighter patterns at longer ranges should result. Second, more energy should be delivered to the target. Based on those two benefits, the effective range of a weapon using that buckshot load should be significantly increased. In order to reduce the parasitic weight of the load as well as provide a material with a high compression strength, a low density material such as a glass syntactic filled phenolic is preferred.

Figure 1:
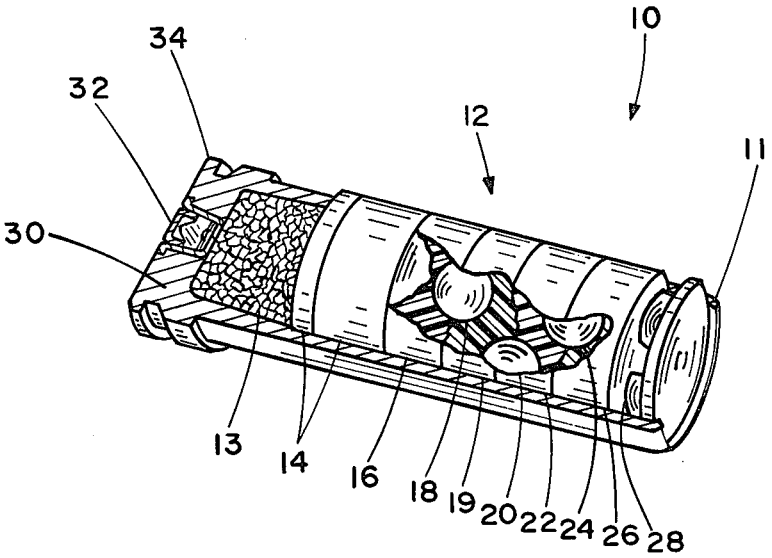
FIG. 1 is a side elevational shot column cutaway showing dimpled quarter cylinder sabot segments and buckshot with over-power wad in a 12 gauge brass shotshell case.

Looking at FIG. 1, a preferred shotshell cartridge 10 is seen which includes a brass shotshell case 11 in which is disposed a shot column 12 which comprises from top to bottom, a powder charge 13 and over powder wad 14, a bottom sabot layer 16, a bottom shot layer 18, a second sabot layer 19, a second shot layer 20, a third sabot layer 22, a third shot layer 24, a fourth sabot layer 26, and a fourth shot layer 28. In addition, shotshell case 11 includes a base wad 30 with a funnel-shaped primer pocket 32 therethrough and a belted head 34 to prevent loading in a commercial shotgun. The belted shotshell case is the subject matter of a copending, commonly assigned patent application as is the funnel-shaped primer pocket. As is readily apparent, the shot layers 18, 20, 24, and 28 are each supported and separated from one another by their associated underlying sabot layers 16, 19, 22, and 26.

Figure 2:
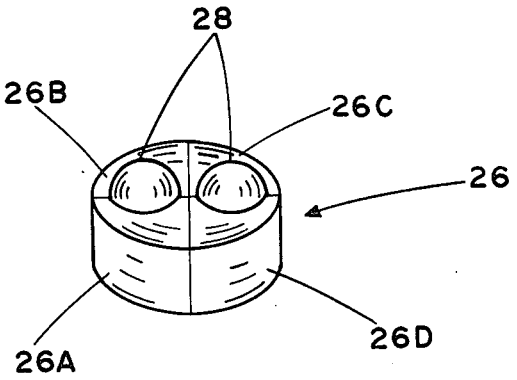
FIG. 2 is a stack of four matching quarter cylinder sabot segments with two lead 000 buckshot in position supported by the sabot segments.
Figure 3:
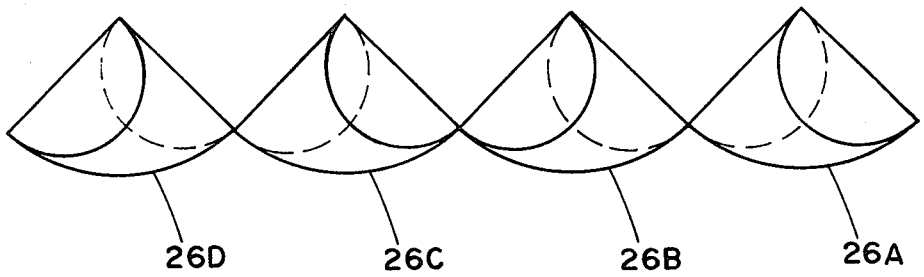
FIG. 3 is a top exploded view of the four sabot segments which make up a sabot layer to lie under each shot layer.

Referring to FIG. 2, support is seen in more detail by showing that fourth shot layer 28 is supported in dimples on the top of fourth sabot layer 26. In FIG. 3, the sabot layer 26 is shown with its four quarter cylinder sabot segments 26*a, b, c,* and *d* each having a half dimple so that when all four are matched they form a cylindrical layer with two dimples on the top and two dimples on the bottom, each of the dimples being adapted to receive a shot pellet. The dimples are preferably hemispherical so that the sabot segments lie flush against each other with the shot pellets individually supported and separated therebetween.

Figure 4:
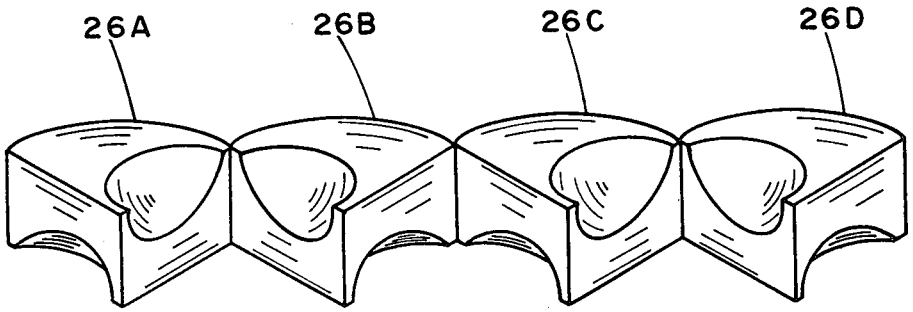
FIG. 4 is a perspective view of the sabot layer of FIG. 3 showing the two types of sabot segments used.

FIGS. 3 and 4 show that there are really only two types of sabot segments needed since sabot segments 26*a* and 26*c* are identical and sabot segments 26*b* and 26*d* are identical. Similarly, there are only two segments needed for each of the other sabot layers. It will be appreciated that if the shot size changes then the number of dimples in each sabot layer would change and the dimple configuration would need to be modified accordingly. It will be appreciated and understood that the maximum benefits from the sabot would be achieved where the buckshot is quite large since these large buckshot pellets are heavier and hence more likely to deform and because fewer sabot segments would be needed if there are fewer layers of shot. Also, it will be appreciated that there is some point at which the wafers would become so thin that they would likely become impractical or break apart during firing. Routine trial and error would determine at what point diminishing returns would economically rule out any smaller shot sizes for sabot shot.

With the above disclosure in mind, it will be understood and appreciated that the particular shot size and sabot configuration could be modified within the scope of the invention and the following claims should therefore be accorded the broad scope of equivalence to which they are entitled.

I claim:

1. A sphericity protective sabot for shot pellets of a single shot size of at least 0.30" diameter, which sabot comprises:

a first cylindrical wafer of low density material having hemispherical dimples on upper and lower surfaces thereof, each said dimples conforming to and adapted to receive and surround the lower or upper portion, respectively, of one of said shot pellets whereby to help maintain the sphericity of said shot pellets when fired through a non-rifled barrel; and a second cylindrical wafer identical to said first wafer and adapted to stack coaxially atop said first wafer, the dimples on the lower surface of said second wafer being adapted to be aligned with said dimples in the upper surface of said first wafer whereby to define a spherical cavity adapted to surround and protect said shot during said firing.

2. The sabot of claim 1 in combination with a shot pellet in each of the cavities cooperatively defined by aligned dimples on the upper surface of said first wafer and lower surface of said second wafer.

3. The combination of claim 2 further comprising:

a third and fourth sabot wafer stacked coaxially atop and in alignment with said first and second wafers whereby to define additional pellet receiving cavities.

4. The sabot of claim 1 wherein said sabot comprises four quarter cylindrical segments.

5. The sabot of claim 4 wherein the wafer is separated into said quarter cylindrical segments by four axially extending radial separation planes passing through the center of said dimples whereby to divide said dimples into two quarter spherical shot cavities located in opposed junctures of said separation planes with one of the upper and lower surfaces of said wafer.

* * * * *